US008369765B2

(12) United States Patent
Arimoto

(10) Patent No.: US 8,369,765 B2
(45) Date of Patent: Feb. 5, 2013

(54) ROTATIONAL HEATING MEMBER, AND IMAGE HEATING APPARATUS HAVING ROTATIONAL HEATING MEMBER

(75) Inventor: Kota Arimoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 292 days.

(21) Appl. No.: 12/847,281

(22) Filed: Jul. 30, 2010

(65) Prior Publication Data

US 2011/0026990 A1 Feb. 3, 2011

(30) Foreign Application Priority Data

Jul. 31, 2009 (JP) ..... 2009-179026

(51) Int. Cl.
*G03G 15/20* (2006.01)

(52) U.S. Cl. ..... 399/333; 399/328; 399/334

(58) Field of Classification Search ..... 399/328–331, 399/333, 334
See application file for complete search history.

(56) References Cited

U.S. PATENT DOCUMENTS

| | | | |
|---|---|---|---|
| 5,722,025 | A | 2/1998 | Morigami et al. |
| 7,283,780 | B2 | 10/2007 | Uchida et al. |
| 7,536,145 | B2 | 5/2009 | Tomine et al. |
| 7,561,818 | B2 | 7/2009 | Arimoto et al. |
| 7,684,724 | B2 | 3/2010 | Arimoto et al. |
| 7,764,895 | B2 | 7/2010 | Tomine et al. |
| 2007/0059021 | A1 | 3/2007 | Hanashi et al. |
| 2009/0169231 | A1 | 7/2009 | Asakura et al. |
| 2010/0180785 | A1 | 7/2010 | Arimoto et al. |

FOREIGN PATENT DOCUMENTS

| | | | |
|---|---|---|---|
| JP | 59155874 | A * | 9/1984 |
| JP | 1-177576 | | 7/1989 |
| JP | 4-204980 | | 7/1992 |
| JP | 4-326386 | | 11/1992 |
| JP | 4-328594 | | 11/1992 |
| JP | 8-278716 | | 10/1996 |
| JP | 9-114295 | | 5/1997 |
| JP | 2006-293225 | | 10/2006 |
| JP | 2009157108 | | 7/2009 |

* cited by examiner

*Primary Examiner* — Joseph S Wong
(74) *Attorney, Agent, or Firm* — Fitzpatrick, Cella, Harper & Scinto

(57) ABSTRACT

An image heating rotatable member for heating an image on a recording material, includes a base layer, a heat generation layer, provided on the base layer, for generating heat by being supplied with electric power, an electrode layer, provided outside of the heat generation layer with respect to a widthwise direction and having an electric resistance which is smaller than that of the heat generation layer, for supplying the electric power to heat generation layer, an elastic layer provided on the electrode layer and having a length longer than that of the electrode layer measured in the widthwise direction, and a parting layer provided on the elastic layer.

5 Claims, 6 Drawing Sheets

(a)

(b)

(a)

(b)

(a)

(b)

ROTATIONAL HEATING MEMBER, AND IMAGE HEATING APPARATUS HAVING ROTATIONAL HEATING MEMBER

FIELD OF THE INVENTION AND RELATED ART

The present invention relates to a rotational heating member which is suitable as a fixing member of an image fixing apparatus (fixing device) mountable in image forming apparatuses such as an electrophotographic copy machines, electrophotographic printers, and the like. It also relates image heating apparatuses which use a rotational image heating member.

There have been increasing activities to reduce in energy consumption, image heating apparatuses (fixing devices) which are mounted in electrophotographic copy machines, electrophotographic printers, and the like. More specifically, various efforts have been made to reduce image heating apparatuses in the so-called "startup" time, that is, the length of time it takes for an image heating apparatus to become ready for image formation after it is turned on. As one of such efforts, a fixing apparatus of the belt type has been proposed, which uses a belt as a part of the fixing means. It is structured so that an unfixed toner image on recording medium is heated through a belt (fixation belt). For example, Japanese Laid-open Patent Application 2006-293225 and Japanese Laid-open Patent Application H04-204980 propose fixing apparatuses of the belt type. These fixing apparatuses have a ceramic heater (which hereafter will be referred to simply as heater), a belt (fixation belt), and a pressure roller. The fixation belt is made of thin film. It is pressed against the heater by the pressure roller, forming a nip between itself and pressure roller. In operation, the fixation belt is moved in contact with the heater. Fixing apparatuses of this type have various advantages over fixing apparatuses of the other types. For example, their heater and fixation belt are relatively small in thermal capacity, and therefore, relatively short (quick start) in the length of time it takes for them to become ready for image formation after they are turned on. Further, they are substantially smaller in electric power consumption (reduction in electric power consumption) while they are kept on standby. Japanese Laid-open Patent Applications H01-177576, H04-328594, H04-326386, and H09-114295 disclose another example of the image heating apparatus of the aforementioned type. This image heating apparatus heats the toner image on recording medium with the use of a rotational heating member made up of a rotational core, and a heat generating cylindrical heating member which rotates with the core. The heat generating cylindrical member is made of a substance which generates heat as electric current is flowed through it.

Fixing apparatuses which employ a fixation belt suffer from the following weaknesses. That is, if they become unstable in the transmission of electric power to their heater, they become unreliable in the length of startup time. Further, if the transmission of electric power to the heater becomes unstable while recording medium is conveyed through their fixation nip, they fail to supply the fixation belt with heat by the amount necessary to properly fix the toner image, and therefore, cannot properly fix the toner image on the recording medium; the so-called cold offset occur. Thus, the primary object of the present invention is to provide a rotational heating member which is significantly shorter than any of conventional rotational heating members, in the startup time, that is, the length of time it takes for the rotational heating member to become ready for properly heating recording medium, on which an image is present, and also, does not cause the cold offset. It is also to provide an image heating apparatus which employs the rotational heating member in accordance with the present invention.

SUMMARY OF THE INVENTION

The primary object of the present invention is to provide a rotational heating member which is significantly shorter in startup time than any of conventional heating members, and an image heating apparatus which employs such a rotational heating member.

According to an aspect of the present invention, there is provided an image heating rotatable member for heating an image on a recording material, comprising: a base layer; a heat generation layer, provided on the base layer, for generating heat by being supplied with electric power; an electrode layer, provided outside of the heat generation layer with respect to a widthwise direction and having an electric resistance which is smaller than that of the heat generation layer, for supplying the electric power to heat generation layer; an elastic layer provided on the electrode layer and having a length longer than that of the electrode layer measured in the widthwise direction; and a parting layer provided on the elastic layer.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 1(*b*) is a schematic sectional view of the same fixing apparatus as the one shown in FIG. 1(*a*), at a plane parallel to the lengthwise direction of the fixing apparatus.

FIG. 2(*b*) is a sectional view of a part of a heat generating portion of the fixation belt of the fixing apparatus, and depicts the laminar structure of the fixation belt.

FIG. 4(*b*) is a graph which shows the relationship between the dimension of the heat generating layer in terms of the lengthwise direction of the fixing apparatus, and the temperature of the fixation belt.

DETAILED DESCRIPTION OF THE PREFERRED EMBODIMENTS

Embodiment 1

Image Forming Apparatus

Figure 6:
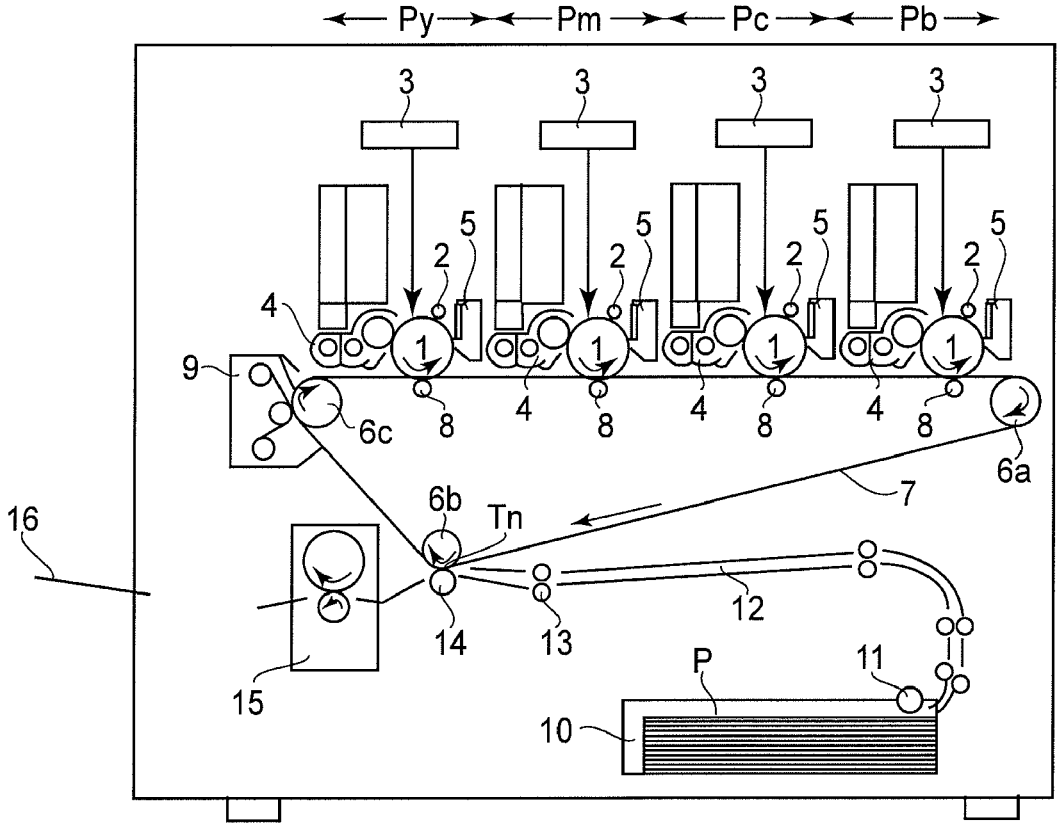
FIG. 6 is a vertical sectional view of a typical image forming apparatus.

FIG. 6 is a schematic sectional view of a typical image forming apparatus in which an image heating apparatus in accordance with the present invention can be mounted as its image heating apparatus. It depicts the structure the apparatus. This image forming apparatus is an electrophotographic color printer. The image forming apparatus in this embodiment has four image forming portions, that is, first to fourth image forming portions Py, Pm, Pc, and Pb, which are disposed in parallel in the image forming apparatus. The four image forming portions form four monochromatic toner images, different in color, one for one, through the charging, exposing, developing, and transfer processes. The image forming apparatus forms images by performing a preset image formation sequence in response to print signals outputted from external apparatus (unshown) such as a host computer. More specifically, the image forming portions Py, Pm, Pc, and Pb are sequentially driven, whereby the photosensitive drum 1 (image bearing member) of each image forming portion P is rotated at a preset peripheral velocity (process speed) in the direction indicated by an arrow mark. The image forming apparatus is provided also with an intermediary transfer belt 7, which is supported, and kept stretched, by a driver roller 6*a*, a follower roller 6*b*, and a tension roller 6*c* so that it is kept in contact with the photosensitive drum 1 of each of the image forming portions Py, Pm, Pc, and Pb. The intermediary transfer belt 7 is circularly driven by the driver roller 6*a* at a peripheral velocity which corresponds to the peripheral velocity of each photosensitive drum 1, in the direction indicated by another arrow mark. In the yellow (first color) image forming portion Py, the peripheral surface of the photosensitive drum 1 is uniformly charged to preset polarity and potential level by a charging device 2. Then, an exposing apparatus 3 scans (exposes) the charged portion of the peripheral surface of the photosensitive drum 1, with a beam of laser light it projects while modulating the beam of laser light with image formation signals (information) sent from an external apparatus. As a result, an electrostatic latent image which reflects the image formation signals is formed on the peripheral surface of the photosensitive drum 1. This latent image is developed by a developing apparatus 4, which uses yellow toner (developer), into a visible image; a visible image of yellow color (which hereafter will be referred to as yellow toner image) is formed of the yellow toner, on the peripheral surface of the photosensitive drum 1. Processes similar to the above described processes for forming a yellow toner image are carried out in the magenta (second color) image forming portion Pm, cyan (third color) image forming portion Pc, and black (fourth color) image forming portion Pb, one for one. The four toner images which were formed in the image forming portions Py, Pm, Pc, and Pb, one for one, and are different in color, are sequentially transferred in layers onto the outward (surface) of the intermediary transfer belt 7 by four primary transfer rollers 8 which oppose the four photosensitive drums 1 with the presence of the intermediary transfer belt 7 between the transfer rollers 8 and photosensitive drums 1, one for one. As a result, a full-color toner image is borne on the outward surface of the intermediary transfer belt 7. Meanwhile, one of the sheets of recording mediums P which are stored in layers in a recording medium feeding-and-conveying cassette 10 is moved out of the cassette 10, while being separated from the rest, and into the main assembly of the image forming apparatus, by a feed roller 11. Then, the sheet of recording medium P (which hereafter will be referred to simply as recording medium P) is sent by the feed roller 11 to a pair of registration rollers 13 through a recording medium guidance path 12. Then, the recording medium P is conveyed by the pair of registration rollers 13 to a second transfer nip Tn, which is the interface between the intermediary transfer belt 7 and a second transfer roller 14. Then, the recording medium P is conveyed through the second transfer nip Tn while remaining pinched by the intermediary transfer belt 7 and second transfer roller 14. While the recording medium P is conveyed through the second transfer nip Tn, the full color toner image on the outward surface of the intermediary transfer belt 7 is transferred by the second transfer roller 14 onto the recording medium P. Then, the recording medium P, on which the unfixed full-color toner image is present, is introduced into a fixing apparatus 15, and conveyed through the nip (which will be described later in detail) of the fixing apparatus 15, while remaining pinched by the nip. As the recording medium P is conveyed through the nip, the unfixed toner image on the recording medium P is thermally fixed to the recording medium P. After coming out of the fixing apparatus 15, the recording medium P is discharged into a delivery tray 16. After the transfer of a toner image from each photosensitive drum 1, the transfer residual toner, that is, the toner remaining on the peripheral surface of the photosensitive drum 1, is removed by a drum cleaner 5. Then, the photosensitive drum 1 is used for the next round of image formation. After the transfer of the full-color toner image from the intermediary transfer belt 7, the transfer residual toner, that is, the toner remaining of the outward surface of the intermediary transfer belt 7, is removed by a belt cleaner 9. Then the intermediary transfer belt 7 is used for the next round of image formation.

(Fixing Apparatus)

Figure 1:
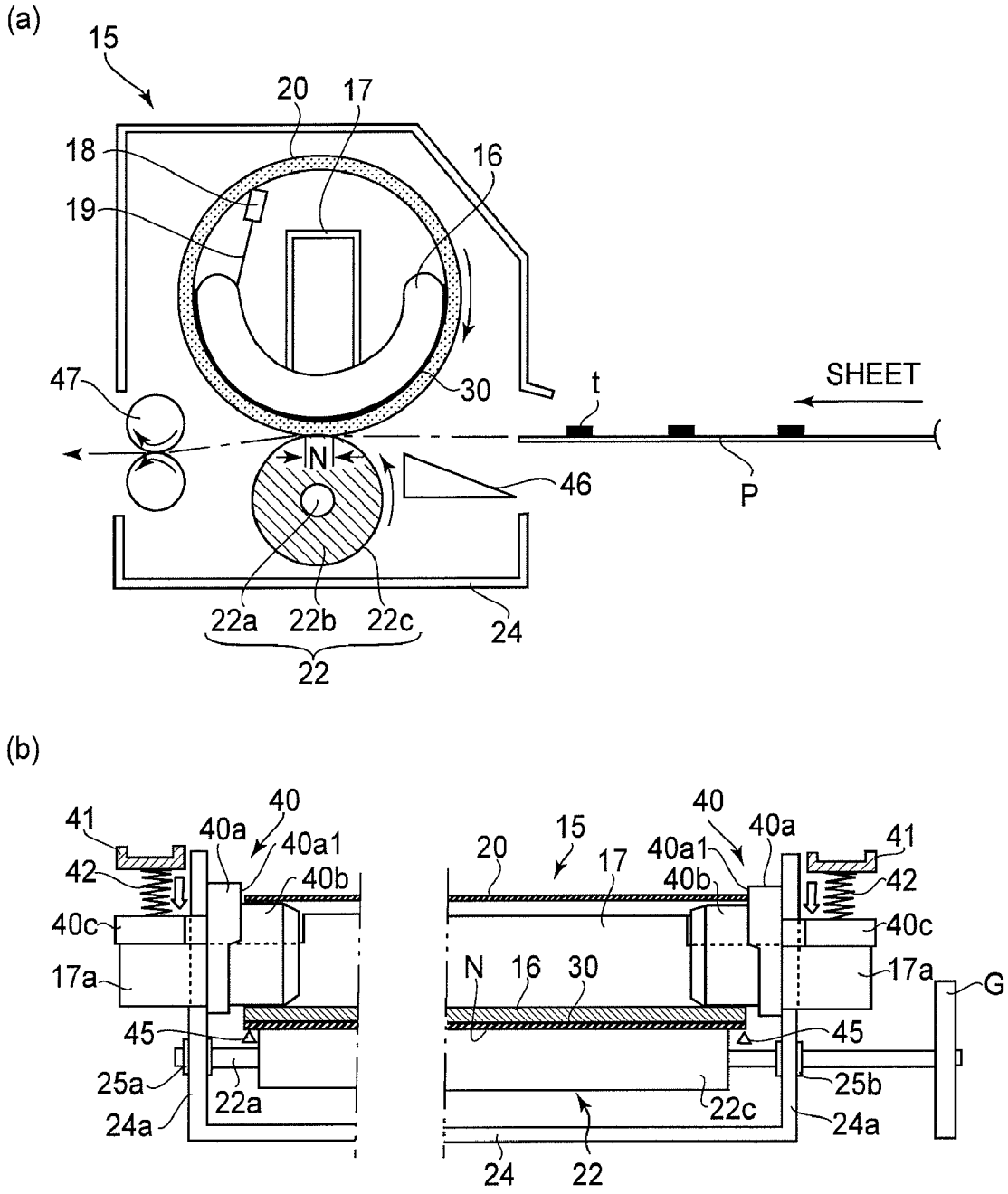
FIG. 1(*a*) is a schematic sectional view of a typical fixing apparatus, at a plane perpendicular to the lengthwise direction of the fixing apparatus.
Figure 2:
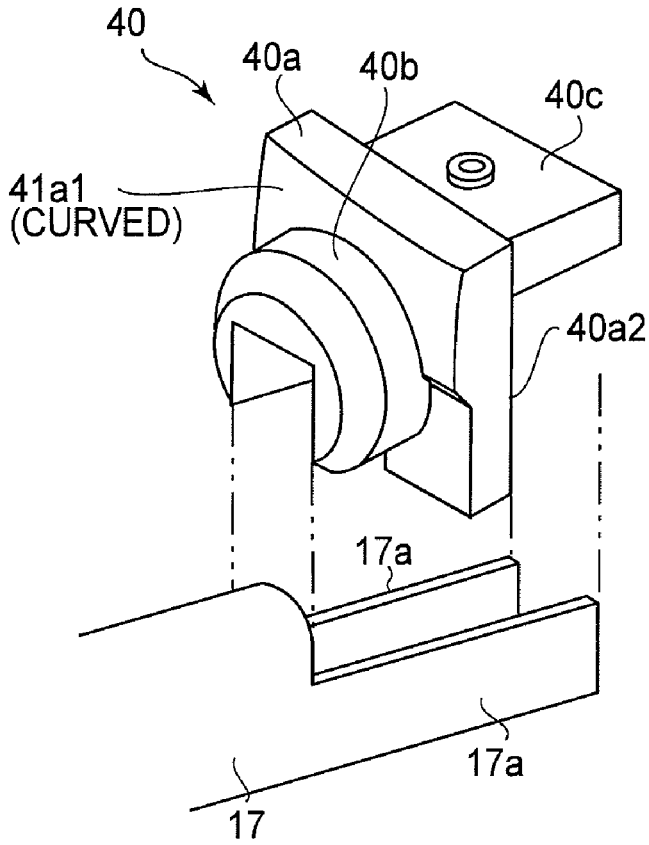
FIG. 2(*a*) is a perspective view of the pressure application stay and fixation flange of the fixing apparatus shown in FIGS. 1(*a*) and 1(*b*), and shows the relationship between the pressure application stay and fixation flange.
Figure 2:
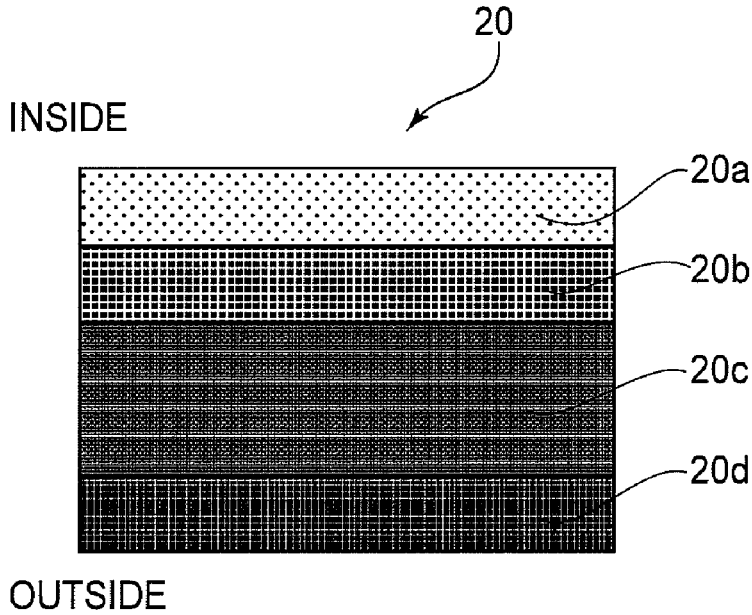

In the following description of the fixing apparatus, and the components, members, etc., which makes up the fixing apparatus 15, the "lengthwise direction" means the direction which is perpendicular to the recoding medium conveyance direction. The "widthwise direction" means the direction parallel to the recording medium conveyance direction. The "length" of a given component means the dimension of the component in the "lengthwise direction". The width of a given component means the measurement of the component in the "widthwise direction". The "widthwise direction" of the recording medium P means the direction of the edges of the recording medium, which is perpendicular to the recording medium conveyance direction. The "width" of the recording medium P means the dimension of the recording medium P, which is parallel to the widthwise direction of the recording medium P. FIG. 1(*a*) is a schematic sectional view of the fixing apparatus 15, which is a typical fixing apparatus, at a plane perpendicular to the lengthwise direction of the fixing apparatus 15. FIG. 1(*b*) is a schematic sectional view of the fixing apparatus 15 in FIG. 1(*a*), at a plane which coincides with the axial line of the pressure roller 22. FIG. 2(*a*) is a perspective view of the combination of the pressure application stay and fixation belt positioning flange (which hereafter will be referred to simply as fixation flange) of the fixing apparatus 15 shown in FIG. 1, and shows the positional relationship between the pressure application stay and fixation flange. The fixing apparatus 15 in this embodiment has: a fixation belt 20, a pressure roller 22, and a belt holder 16. The fixation belt 20 is a rotational heating member, and the pressure roller 22 is a member for backing up the fixation belt 20. The belt holder 16 is a member for holding the fixation belt 20. The fixing apparatus 15 has also a pressure application stay 17, an adiabatic sheet 30, and a pair of the fixation flanges 40 and 40. The pressure application stay 17 is a pressure applying member. The adiabatic sheet 30 is a heat shield. The fixation flanges 40 and 40 are members for keeping the fixation belt 20 proper in shape at the edges of the fixation belt 20. The lengthwise direction of the fixation belt 20, pressure roller 22, belt holder 16, pressure application stay 17, and adiabatic sheet 30 is the same as that of the fixing apparatus 15.

The fixing apparatus 15 in this embodiment has the fixation belt 20, belt holder 16, and pressure application stay 17, as described above. The fixation belt 20 is cylindrical (endless). The belt holder 16 is roughly semicircular in cross section, heat resistant, and rigid, and is on the inward side of the cylindrical fixation belt 20. The pressure application stay 17 is roughly U-shaped in cross section, and is also on inward side of the fixation belt 20. Further, the pressure application stay 17 is placed on inward side of the belt holder 16, being positioned in contact with the inward side of the belt holder 16 in such a manner that its open side faces the belt holder 16. From the standpoint of reducing the fixing apparatus 15 in energy consumption, the belt holder 16 is desired to be formed of a substance which is low in thermal conductivity. In this embodiment, therefore, a heat resist substance, for example, heat resistant glass, or heat resistant resin such as polycarbonate, is used as the material for the belt holder 16. The pressure application stay 17 is desired to be unlikely to flex even if it comes under a large amount of pressure. In the first embodiment, therefore, SUS 304 is used as the material for the pressure application stay 17. The pressure roller 22 is below the fixation belt 20, and is parallel to the fixation belt 20. The pressure roller 22 is made up of a metallic core 22*a* and an elastic layer 2*b*. The metallic core 22*a* is made of stainless steel. The elastic layer 22*b* is made of silicone rubber, and is roughly 3 mm in thickness. It covers the entirety of the peripheral surface of the metallic core 22*a*. The pressure roller 22 has also a parting layer 22*c* which covers the entirety of the peripheral surface of the elastic layer 22*b*. It is a piece of PFA resin tube, and is roughly 40 μm in thickness. The pressure roller 22 is rotatably supported by the frame 24 of the fixing apparatus 15. More specifically, the lengthwise end portions of the metallic core 22*a* of the pressure roller 22 are rotatably supported by a pair of bearings 25*a* and 25*b* attached to the front and rear plates of the frame 24, respectively. The adiabatic sheet 30 is for preventing the heat from the fixing belt 20 conducting to the belt holder 16 and pressure application stay 17. It is between the inward surface of the fixation belt 20 and the outward surface of the belt holder 16, and is held to the outward surface of the belt holder by adhesive. The adiabatic sheet 30 is a piece of silicone sponge, and is 500 μm in thickness. The fixation flanges 40 and 40 are at the lengthwise ends of the pressure application stay 17, one for one. Each pressure application stay 40 has a substrate 40*a* (FIG. 1(*b*)) which faces the corresponding edge of the fixation belt 20. The fixation flange 40 has also a belt supporting portion 40*b*, which projects inward of the fixing apparatus 15 from the inward surface 40*a*1 of the substrate 40. The substrate 40*a* has also a spring seat 40*c* which projects from the outward surface 40*a*2, that is, the opposite surface from the fixation belt 20, outward of the fixing apparatus 15. The fixation flanges 40 are solidly attached to the side plates 24*a* and 24*b* of the apparatus frame 24 by the spring seats 40*c* and 40*c*, one for one. Further, the fixation flanges 40 and 40 are held to a pair of outwardly extending arms 17*a* and 17*a* which are lengthwise end portions of the pressure application stay 17, by the bottom portion of the substrates 40*a* and 40*a*. The belt holding portions 40*b* and 40*b* are fitted inward of the loop which the fixation belt 20 forms, in such a manner that each edge of the fixation belt 20 is in contact with the inward surface 40*a*1 of the corresponding fixation flange 40. There are also a pair of compression springs 42 and 42, which are between the corresponding spring seats 40*c* and 40*c*, and pressure application arms 41 and 41, one for one. The force from the compression springs 42 is applied to the belt holder 16 through the pressure application stay 17, whereby the outward surface of the fixation belt 20 is kept pressed upon the peripheral surface of the pressure roller 22. The pressure applied to the peripheral surface of the pressure roller 22 causes the elastic layer 22*b* of the pressure roller 22 to resiliently deform, forming a nip N (fixation nip) with a preset width, between the outward surface of the fixation belt 20 and peripheral surface of the pressure roller 22. In this embodiment, the fixing apparatus 15 is structured so that the amount of pressure applied to each of the lengthwise ends of the pressure application stay 17 becomes 156.8 N, that is, the amount of the combination of the pressure applied to the lengthwise ends of the pressure application stay 17 becomes 313.6 N (32 kgf). Designated by a referential code 18 is a thermistor as a temperature detecting means. The thermistor 18 is positioned above the belt holder 16 in such a manner that it remains in contact with the inward surface of the fixation belt 20 regardless of the movement of the fixation belt 20. The thermistor 18 detects the temperature of the inward surface of the fixation belt 20. More specifically, the thermistor 18 is attached to a stainless steel arm 19 solidly attached to the belt holder 16. The arm 19 is made flexible so that even if the fixation belt 20 becomes unstable in the movement of its inward surface because of its circular movement, the arm 19 absorbs the unstable movement of the inward surface of the fixation belt 20 by flexing. Thus, the thermistor 18 remains always in contact with the inward surface of the fixation belt 20.

Figure 3:
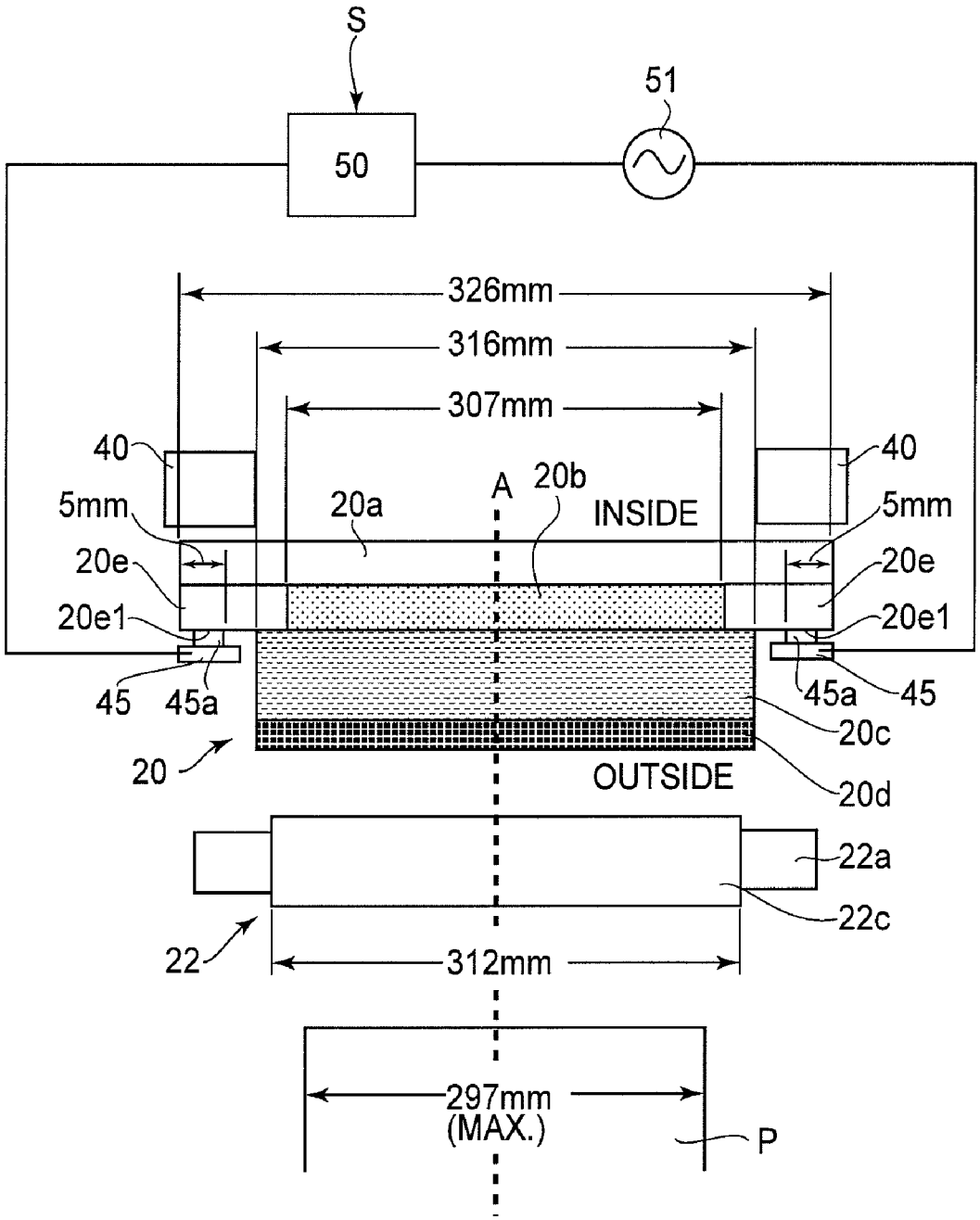
FIG. 3 is a schematic drawing for describing the length of each of the various sublayers of the fixation belt, length of the actual roller portion of the pressure roller, and system for controlling the fixation belt in temperature.
Figure 4:
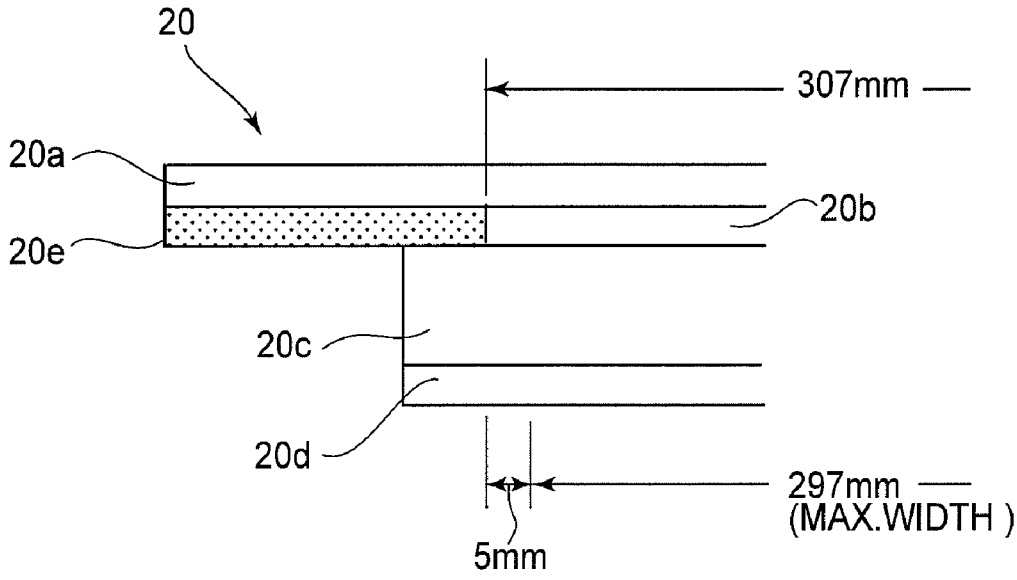
FIG. 4(*a*) is a schematic sectional view of one of the lengthwise end portions of the fixation belt, and shows the laminar structure of the fixation belt.
Figure 4:
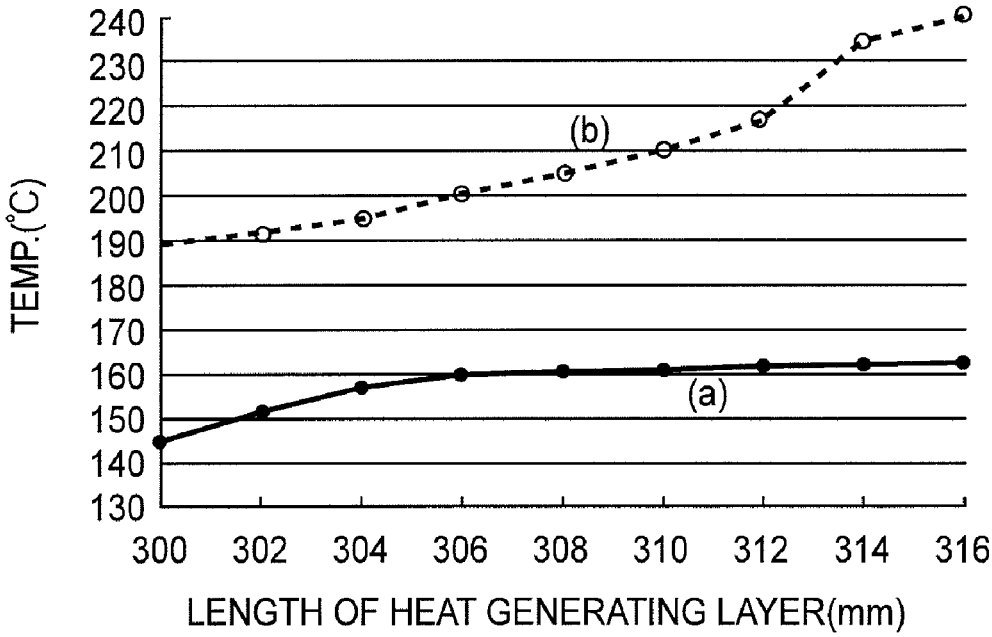

FIG. 2(*b*) is a sectional view of a part of the heat generating portion of the fixation belt 20 of the fixing apparatus 15, and depicts the laminar structure of the fixation belt 20. FIG. 3 is a schematic drawing for describing the length of each of the various sublayers of the fixation belt 20, length of the actual roller portion of the pressure roller 22, and system for controlling the fixation belt 20 in temperature. FIG. 4(*a*) is a schematic sectional view of one of the lengthwise end portions of the fixation belt 20, and depicts the laminar structure of the end portion. The fixation belt 20 is a laminar belt, and has four sublayers, that is, substrate layer 20*a*, a heat generation layer 20*b*, an electric power supplying electrode layer 20*e* (which hereafter will be referred to simply as electrode layer), an elastic layer 20*c*, and a parting layer 20*d*, listing from the inward side of the fixation belt 20. As the material for the substrate layer 20*a*, a heat resistant substance is used. For the minimization of the fixation belt 20 in thermal capacity, that is, for quick start, the thickness of the substrate layer 20*a* is made to be no more than 100 μm, preferably, in a range of 20-50 μm. That is, a belt formed of dielectric resin, for example, polyimide, polyimide-amide, PEEK, PTFE, PFA, FEP, etc., or a belt formed of metallic substance, for example, SUS, nickel, etc., can be used as the substrate layer 20*a*. In this embodiment, a cylindrical polyimide belt, which is 30 μm in thickness, and 25 mm in diameter, was used as the substrate layer 20*a*. Incidentally, in a case where an electrically conductive substance is used as the material for the substrate layer 20*a*, it is necessary for a dielectric layer made of polyimide or the like to be provided between the substrate layer 20*a* and heat generation layer 20*b*. As the material for the elastic layer 20*c* placed on the heat generation layer 20*b* and electrode layers 20*e* and 20*e*, silicon rubber, which was 10 degrees in hardness (JIS-A), and 1.3 w/m·K in thermal conductivity, was used. The thickness of the elastic layer 20*c* was 300 μm. As the material for the parting layer 20*d*, which is placed on the elastic layer 20*c*, a piece of PFA tube, which is formed of fluorinated resin, was used. The thickness of the parting layer 20*d* was 20 μm. The parting layer 20*d* is placed in such a manner that it opposes both the heat generation layer 20*b* and electrode layer 20*e* through the elastic layer 20*c*. The parting layer 20*d* may be formed by coating the elastic layer 20*c* with PFA. That is, whether the parting layer 20*d* is to be formed of a pieces of PFA tube, or the elastic layer 20*c* is to be coated with PFA to form the parting layer 20*d* may be decided according to the amount of mechanical and electrical strength of which the parting layer 20*d* is required. The parting layer 20*d* is held to the elastic layer 20*c* with adhesive formed of silicone resin. The heat generation layer 20*b* is a layer of a substance which generates heat as electric current is flowed through it. It is formed on the substrate layer 20*a* by uniformly coating the substance, which contains silver-palladium alloy, on the substrate layer 20*a*. It is 10.0Ω in total amount of electric resistance. Thus, the amount of electric power which is generated as electric current is flowed through the heat generation layer 20*b* with the use of an AC electric power source which is 100 V in voltage, is 1,000 W. The total amount of electric resistance for the heat generation layer 20*b* should be set according to the amount of the heat required of the fixing apparatus 15.

Next, the various sublayers of fixation belt 20, and the elastic layer of the pressure roller 22, will be described regarding their length. The width of the largest recording medium P, in terms of the lengthwise direction, usable with the image forming apparatus in this embodiment is 297 mm. The image forming apparatus in this embodiment is designed so that when the recording medium P is conveyed through the apparatus, the center of the recording medium passage in the apparatus in the "lengthwise direction" coincides with the center of the recording medium P in the "widthwise direction" of the recording medium P. That is, a broken line A in FIG. 3, which is the center line of the fixing apparatus 15 in terms of the "lengthwise direction", is the referential line for recording medium conveyance. In other words, the recording medium P is conveyed so that the center line A of the recording medium P in terms of its "widthwise direction", coincides with the recording medium conveyance reference line A. Referring to FIG. 3, the substrate layer 20*a* of the fixation belt 20 is 326 mm in length, and the elastic layer 20*c* and parting layer 20*d* are 316 mm in length. The actual roller portion, that is, elastic layer portion, of the pressure roller 22 is 312 mm in length. In terms of the "lengthwise direction", the centers of the substrate layer 20*a*, elastic layer 20*c*, and parting layer 20*d* of the fixation belt 20 coincide with the recording medium conveyance reference line A. Further, the center of the elastic layer 22*b* of the pressure roller 22 also coincides with the recording medium conveyance reference line A. That is, the front halves of the sublayers 20*a*, 20*c*, and 22*b* are symmetrical with their rear halves with reference to the recording medium conveyance reference line A. The heat generation layer 20*b* is 307 mm in length. Therefore, when the recording medium P of the maximum size (297 mm) in terms of its "widthlengthwise direction" is conveyed through the fixing apparatus 15, the heat generation layer 20*b* extends 5 mm beyond the edge of the recording medium P at both lengthwise ends (FIG. 4(*a*)). Generally speaking, the heat generated in the heat generation layer 20*b* transmits (radiates) outward. Therefore, the lengthwise end portions of the heat generation layer 20*b* of the fixation belt 20 of conventional fixing apparatuses (15) are lower in temperature than the center portion of the heat generation layer 20*b*, being therefore unable to supply the corresponding portion of the fixation belt 20 with heat by an amount necessary for proper fixation, being therefore likely to cause the so-called cold offset. This is why the heat generation layer 20*b* in this embodiment was made long enough for its lengthwise ends to extend beyond the corresponding edges of the recording medium P by 5 mm, in order to keep uniform in temperature, the portion of the heat generation layer 20*b*, which corresponds in position to the recording medium path. The electrode layers 20*e* and 20*e*, which are for allowing electric current to flow through the heat generation layer 20*b*, extend outward from the corresponding lengthwise ends of the heat generation layer 20*b* (electrode layers are outside heat generation layer 20*b* in terms of lengthwise direction). More specifically, the electrode layers 20*e* and 20*e* are on the outward surface of the substrate layer 20*a*, and are formed by uniformly coating the outward surface of the heat generation layer 20*b* with electrically conductive substance, in contact with the heat generation layer 20*b*, to a thickness of roughly 30 μm. The combined electrical resistance of the two electrode layers 20*e* and 20*e* is roughly 0.1Ω, which amounts to roughly 1% of the total electrical resistance of the heat generation layer 20*b*. That is, the amount of heat which the electrode layers 20*e* and 20*e* generate is roughly 1% of that of the heat generation layer 20*b*; the electrode layers 20*e* and 20*e* are negligibly small in electrical resistance compared to the heat generation layer 20*b*. Thus, it does not occur that the end portions of the fixation belt 20 in terms of the lengthwise direction excessively is excessively increased in temperature by the electrode layer 20*e* and 20*e*, and therefore, it does not occur that the fixation belt 20 breaks because of the excessive increase in temperature of its lengthwise ends (edges) caused by the electrode layers 20*e* and 20*e*. Further, the inwardly facing surface of electrode layers 20*e* and 20*e* are exposed by 5 mm across the outward end portions, in terms of the lengthwise direction. It is with these exposed portions 20*e*1 and 20*e*1 that a pair of members 45 and 45 for supplying the heat generation layer 20*b* with electric power are in connection. More specifically, the power supplying members 45 and 45 are in contact with the electrode layers 20*e* and 20*e*, in the area of contact between the lengthwise end portions (edges) of the fixation belt 20, and the outward surface of the belt holding portions 40. In this embodiment, a pair of electrically conductive leaf springs are used as the power supplying members 45 and 45. Each of the pair of leaf springs (power supplying members) is provided with an electrically conductive contact point formed of carbon. The pair of electrically conductive leaf springs 45 and 45 are kept in contact with the exposed portions 20*e*1 and 20*e*1 of the electrode layer 20*e* and 20*e*, one for one, by the application of pressure, whereby the pair of leaf springs 45 and 45 remain in contact with the heat generation layer 20*b* through the electrode layers 20*e* and 20*e*. Further, the pair of leaf springs 45 and 45 are in connection with an electrical power source 51 through a heater driving circuit 50 as a controlling means.

(Operation of Fixing Apparatus for Thermally Fixing Toner Image)

The operation of the fixing apparatus 15 in this embodiment is as follows: the fixation motor (unshown) of the fixing apparatus 15 is rotationally driven in response to a print signal, whereby the pressure roller driving gear G (FIG. 1(*b*)) attached to one of the lengthwise ends of the metallic core 22*a* of the pressure roller 22 is rotated. Thus, the pressure roller 22 rotates in the direction indicated by an arrow mark at a preset peripheral velocity (process speed). The rotation of the pressure roller 22 is transmitted to the outward surface of the fixation belt 20 by the friction which occurs between the peripheral surface of the pressure roller 22 and the outward surface of the fixation belt 20, in the nip N. Therefore, the fixation belt 20 is circularly moved by the rotation of the pressure roller 22 in the direction indicated by an arrow mark at roughly the same speed as the peripheral velocity of the pressure roller 22, while the inward surface of the fixation belt 20 remains in contact with the outward surface of the belt holding portion 40*b* of the fixation flange 40. While the fixation belt 20 rotates, its inward surface remains in contact with the outward surface of the belt holding portion 40*b* of the fixation flange 40. Therefore, the fixation belt 20 remains stable in its track. In particular, in this embodiment, the value for the circumference of the peripheral surface of the belt holding portion 40*b* is set so that the sum of the length of the surface of the belt holding portion 40*b* which is in contact with the inward surface of the fixation belt 20, and the length of the surface of the belt holder 16, becomes roughly 2% smaller than the internal diameter of the fixation belt 20. This setup can prevent the problem that the fixation belt 20 slackens and/or becomes wavy across its "lengthwise" end portions (edges) while the fixing apparatus 15 is driven. Therefore, it is ensured that while the fixing apparatus 15 is driven, the "lengthwise" end portions of the fixation belt 20 remains in contact with the peripheral surface of the belt holding portion 40*b* of the fixation flange 40. That is, the fixation belt 20 remains stable in its track across the areas which correspond to the lengthwise end portion of the fixation flange 40. Further, each of the leaf springs 45 and 45 is electrically in contact with the exposed portion 20*e*1 of the corresponding electrode layer 20*e*, in the area in which the lengthwise end of the fixation belt 20 and the peripheral surface of the belt holding portion 40*b* of the fixation flange 40 are in contact with each other. Therefore, it is ensured that the contact points 45*a* and 45*a* of the leaf springs 45 and 45 remain in contact with the electrode layers 20*e* and 20*e*, which are at the lengthwise ends of the fixation belt 20 which is stable in its track. In other words, it is ensured that the leaf springs 45 and 45 remain in contact with the electrode layers 20*e* and 20*e*, one for one. The inward surface of the fixation belt 20 is coated with grease. The presence of the grease reduces the amount of friction between the belt holder 16 and the inward surface of the fixation belt 20, preventing therefore the inward surface of the fixation belt 20 from being frictionally worn. As a print start signal is inputted, the electric power source 51 of the heater driving circuit 50 is turned on. As a result, electric current is flowed through the heat generation layer 20*b* by way of the leaf springs 45 and 45 and the electrode layers 20*e* and 20*e*. The current causes the heat generation layer 20*b* to generate heat, causing thereby the fixation belt 20 to increase in temperature. More specifically, the heater driving circuit 50 takes in the output signals S (which reflect detected temperature of fixation belt 20) of the thermistor 18, and turns on or off the electric power source 51 in response to the output signals S so that the temperature of the fixation belt 20 remains at a preset level (target temperature for fixation). In this embodiment, the heater driving circuit 50 controls the electric power source 51 so that the temperature of the fixation belt 20 remains at 160° C. While the pressure roller 22 and fixation belt 20 are stable in rotation, and also, the fixation belt 20 is stable in temperature at the preset level (fixation level), the recording medium P, on which an unfixed toner image t (image to be fixed) is present, is introduced into the nip N by an entrance guide 46. Then, the recording medium P is conveyed through the nip N while remaining pinched by the outward surface of the fixation belt 20 and the peripheral surface of the pressure roller 22. While the recording medium P is conveyed through the nip N, it is subjected to the heat applied by the fixation belt 20 and the pressure applied by the pressure roller 22, whereby the toner image t is thermally fixed to the surface of the recording medium P. As the recording medium P comes out of the nip N, it is separated from the surface of the fixation belt 20, and then, is discharged from the fixing apparatus 15 by a pair of discharge rollers 47.

(Relationship Between Dimension of Substrate Layer, Heat Generation Layer, Elastic Layer, Parting Layer, and Elastic Layer of Pressure Roller, and Maximum Width for Recording Medium)

The length of the elastic layer 22*b* of the pressure roller 22 is such that when a sheet of recording medium (P), which is maximum in "width", is conveyed through the fixing apparatus 15, the elastic layer 2*b* extends beyond the edge of the recording medium P by 7.5 mm at both of its lengthwise ends. Further, the substrate layer 20*a*, heat generation layer 20*b*, elastic layer 20*c*, and parting layer of the fixation belt 20 are longer than the elastic layer 22*b* of the pressure roller 22. If the dimension of the elastic layer 22*b* is less than the dimension of the recording medium P in terms of the lengthwise direction ("widthwise direction of recording medium P), the "widthwise" end portions of the recording medium P fail to be pressed by the elastic layer 22*b* (pressure roller 22). Consequently, the recording medium P is bent along the border lines between the pressed portion of the recording medium P and the unpressed portions of the recording medium P. In the case of the fixing apparatus 15 in this embodiment, the length of its elastic layer 22*b* is greater than the maximum "width" for the recording medium P. Therefore, the recording medium P is always pressed across its entirety when it is conveyed through the fixing apparatus 15. Therefore, it does not occur that the recording medium P is bent along the border line between the portion pressed by the elastic layer 22*b* (pressure roller 22) and the portions which were not pressed by the elastic layer 22*b* (pressure roller 22). Also in the case of the fixing apparatus in this embodiment, the parting layer 20*d* of the fixation belt 20 is made longer than the elastic layer 22*b* of the pressure roller 22, by such a length that it extends by 2 mm beyond the elastic layer 22*b* at both lengthwise ends. Further, the heat generation layer 20*b* does not come into contact with the elastic layer 22*b* of the pressure roller 22. Therefore, it does not occur that the heat generation layer 20*b* is frictionally worn by the elastic layer 22*b*. Therefore, it is ensured that even when the fixing apparatus 15 is used for a long time, electric current is reliably flowed through the heat generation layer 20*b*.

The following is the description of the relationship between the length of the heat generation layer 20*b* and the temperature increase which occurred to the lengthwise end portions of the fixation belt 20. FIG. 4(*b*) is a graph which shows the relationship between the length of the heat generating layer and the temperature of the fixation belt. The solid line (a) in FIG. 4(*b*) represents the changes, in temperature, of the portions of the fixation belt 20, which correspond in position to the lengthwise ends (edges) of the recording medium P. The broken line (b) in FIG. 4(*b*) represents the changes, in maximum temperature, of the lengthwise end portions of the fixation belt 20. Table 1 shows the conditions under which an experiment was carried out, and the results of the experiment. The fixing apparatus used in this experiment is the same in structure as the fixing apparatus 15 in this embodiment, except that it is different in the length of the heat generation layer from the fixing apparatus in this embodiment. As described above, because of the outward heat transmission (radiation) from the lengthwise ends of the heat generation layer 20*b* of the fixation belt 20 in terms of the lengthwise direction, the lengthwise end portions of the heat generation layer 20*b* of the fixation belt 20 become lower in temperature than the center portion of the heat generation layer 20*b* of the fixation belt 20 in terms of the lengthwise direction (which hereafter will be referred to as lengthwise center portion of heat generation layer 20*b*). Therefore, in order to keep equal in temperature, the lengthwise center portion of the heat generation layer 20*b* and the portions of the heat generation layer 20*b*, which correspond in position to the "widthwise" ends of the recording medium P, it is necessary for the length of the heat generation layer 20*b* to be no less than 304 mm. On the other hand, making the heat generation layer 20*b* long enough to deal with even the widest recording medium P causes the portions of the fixation belt 20, which are outside the recording medium path in nip N to excessively increase in temperature. For example, if the length of the heat generation layer 20*b* is no less than 314 mm, it is greater than the length of the elastic layer 22*b* of the pressure roller 22, creating thereby the portions from which no heat is given to the pressure roller 22 and recording medium P. Thus, the portions of the heat generation layer 20*b*, from which no heat is given to the pressure roller 22 nor recording medium P excessively increases in temperature.

In the case of the fixation belt 20 in this embodiment, a silicone resin is used as the adhesive to keep the parting layer 20*d* adhered to the elastic layer 20*c*. This silicone resin softens at 210° C., and therefore, becomes ineffective as adhesive. Thus, in the case of a fixation belt (20), the heat generation layer (20*b*) of which is no less the 310 mm in length, its parting layer (20*d*) is likely to separate from the elastic layer 20*c*; the fixation belt (20) is likely to break.

TABLE 1

| | Heat Generation Width | | | | | | | | |
|---|---|---|---|---|---|---|---|---|---|
| | 300 mm | 302 mm | 304 mm | 306 mm | 308 mm | 310 mm | 312 mm | 314 mm | 316 mm |
| Cold Offset | N | N | G | G | G | G | G | G | G |
| Fixing Belt End | G | G | G | G | G | N | N | N | N |

G: Good; and
N: No good

The length of the heat generation layer 20*b* of the fixation belt 20 in this embodiment is 307 mm. Therefore, it is possible to prevent the so-called cold offset from occurring across the "widthwise" end portion of the recording medium P, and also, to prevent the parting layer 20*d* of the fixation belt 20 from separating from the elastic layer 20*c* of the fixation belt 20.

In terms of the widthwise direction of the recording medium P, the electrode layer 20*e* and 20*e* of the fixation belt 20 in this embodiment is on the outward side of the heat generation layer 20*b* of the fixation belt 20. Therefore, the fixing apparatus 15 is stable in the flow of the electric current to the heat generation layer 20*b*. Therefore, it is faster in startup time, that is, the length of time it takes for the fixing apparatus 15 to become ready to properly heat the recording medium P on which the toner image t is present. Also in this embodiment, the heat generation layer 20*b* of the fixation belt 20 is longer than the "width" of the recording medium P, and the parting layer 20*d* of the fixation belt 20 is longer than the heat generation layer 20*b*. Therefore, the so-called cold offset does not occur. Further, the electrode layers 20*e* and 20*e* are smaller in electrical resistance than the heat generation layer 20*b*. Therefore, the fixation belt 20 is unlikely to break across its lengthwise end portions.

The electric power supplying member 45 of the fixing apparatus 15 in this embodiment is the electrically conductive leaf spring 45*b*. However, the electric power supplying member does not need to be the electrically conductive leaf spring 45*b*. For example, it may be an electrically conductive member which is in the form of a brush (unshown). In a case where the electric power supplying member 45 is an electrically conductive member in the form of a brush, it is connected to the exposed portion 20*e*1 of the electrode layer 20*e* of the fixation belt 20. The employment of the above described fixation belt 20 in this embodiment can reduce a fixing apparatus 15 in startup time, that is, the length of time it takes for the fixing apparatus to become ready for properly heating (fixing) the recording medium P, on which the toner image t is present, after electric power begins to be flowed through the fixation belt 20. Further, it can prevent the occurrence of the cold offset, and also, to prevent the lengthwise end portions of the fixation belt 20 from breaking.

Figure 5:
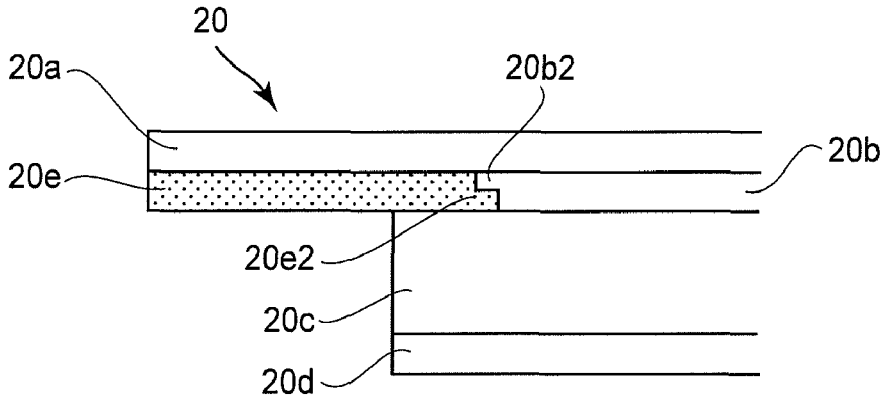
FIG. 5 is a sectional view of one of the lengthwise end portions (edge portions) of the fixation belt, and shows the laminar structure of the fixation belt. More specifically, FIG. 5(*a*) shows an example of the structure of the joint between the heat generation layer and electrode layer, and FIG. 5(*b*) shows another example of the joint structure.
Figure 5:
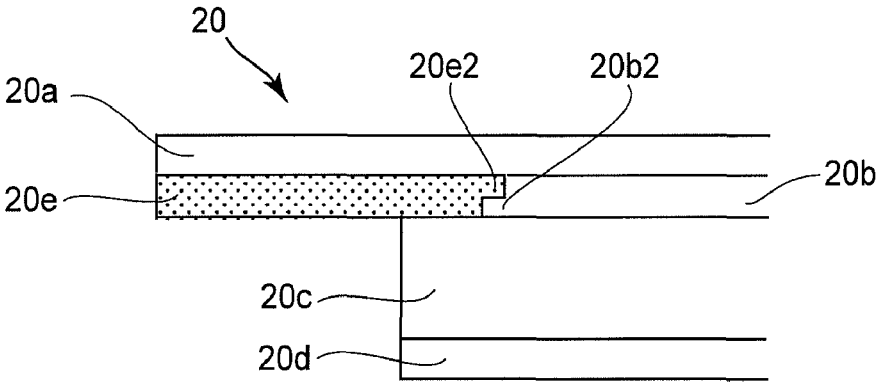

FIG. 5 shows a couple of fixation belts (20) which are different from the fixation belt 20 in this embodiment, in the manner in which the heat generation layer and electrode layer are connected to each other. FIG. 5(*a*) is a schematic sectional view of one of the lengthwise end portions of one of the two fixation belts different from the fixation belt 20 in this embodiment, and shows the laminar structure of the lengthwise end. FIG. 5(*b*) is a schematic sectional view of one of the lengthwise end portions of the other fixation belt (20), and shows the laminar structure of the fixation belt (20). Referring to FIGS. 5(*a*) and 5(*b*), in the case of these fixation belts (20), the lengthwise end of the heat generating layer, which faces the electrode layer 20*e*, and the lengthwise end of the electrode layer 20*e*, which faces the heat generating layer 20*b*, are provided with a portion 20*b*2 and a portion 20*e*2, which are shaped like a step. Thus, the heat generating layer 20*b* and electrode layer 20*e* are connected to each other in such a manner that the portion 20*b*2 of the heat generating layer 20*b* and the portion 20*e*2 of the electrode layer 20*e* overlap with each other. Therefore, it is ensured that the heat generating layer 20*b* and electrode layer 20*e* better connect to each other, and remain more reliably connected to each other.

The following is the description of the method for forming the heat generation layer 20*b* and electrode layer 20*e* on the substrate layer 20*a* by coating the materials for the layers 20*b* and 20*e* on the substrate layer 20*a*. It is possible to coat the substrate layer 20*a* first with the material for the heat generation layer 20*b*, and then, with the material for the electrode layer 20*e*. In this case, the step 20*b*2 is formed on the substrate layer side, that is, not on the elastic layer side, at the lengthwise end of the heat generation layer 20*b*, which faces the substrate layer 20*a* as shown in FIG. 5(*a*). However, it is also possible to coat the substrate layer 20*a* first with the material for the electrode layer 20*e*, and then, with the heat generation layer 20*b*. In this case, it is the step 20*e*2 that is formed on the substrate layer side, that is, not on the elastic layer side, at the lengthwise end of the electrode layer 20*e*, which faces the heat generation layer 20*b*, as shown in FIG. 5(*b*). Whether the joint between the heat generating layer 20*b* and electrode layer 20*e* is formed as shown in FIG. 5(*a*) or 5(*b*), the lengthwise inward end portion of either the heat generation layer 20*b* or electrode layer 20*e* is provided with a step. Therefore, it is ensured that the heat generation layer 20*b* and electrode layer 20*e* are reliably placed and reliably remain in contact with each other.

According to the present invention, it is possible to provide a rotational heating member which is significantly shorter than any of the conventional rotational heating members, in terms of startup time, that is, the length of time it takes for the apparatus to become ready for properly heating recording medium, on which an unfixed image is present, after electric power begins to be supplied to the apparatus, and does not cause the so-called cold offset, and also, to provide an image heating apparatus which employs the rotational image heating member.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No 179026/2009 filed Jul. 31, 2009 which is hereby incorporated by reference.

What is claimed is:

1. An image heating rotatable member for heating an image on a recording material, comprising:

a base layer;

a heat generation layer, provided on base layer, configured to generate heat by being supplied with electric power;

an electrode layer, provided outside of said heat generation layer with respect to a widthwise direction and having an electric resistance which is smaller than that of said heat generation layer, configured to supply the electric power to heat generation layer;

an elastic layer provided on said electrode layer and having a length longer than that of said electrode layer measured in the widthwise direction; and a parting layer provided on said elastic layer, wherein an end, with respect to the widthwise direction, of said heat generation layer is provided with a first stepped portion, and an end of said electrode layer, with respect to the widthwise direction, is provided with a second stepped portion which is connected with said first stepped portion, the end of said electrode layer being adjacent to said heat generation layer.

2. An apparatus according to claim 1, wherein said first stepped portion and said second stepped portion are inside said elastic layer with respect to the widthwise direction.

3. An image heating apparatus for heating an image on a recording material, comprising:

an image heating member configured to heat the recording material; and a pressing member urged toward said image heating member to nip and feed the recording material, said image heating member including:

a heat generation layer, provided on a base layer, configured to generate heat by being supplied with electric power;

an electrode layer, provided outside of said heat generation layer with respect to a widthwise direction and having an electric resistance which is smaller than that of said heat generation layer, configured to supply the electric power to heat generation layer;

an elastic layer provided on said electrode layer and having a length longer than that of said electrode layer measured in the widthwise direction; and a parting layer provided on said elastic layer, wherein an end, with respect to the widthwise direction, of said heat generation layer is provided with a first stepped portion, and an end of said electrode layer, with respect to the widthwise direction, is provided with a second stepped portion which is connected with said first stepped portion, the end of said electrode layer being adjacent to said heat generation layer.

4. An apparatus according to claim 3, wherein said first stepped portion and said second stepped portion are inside said elastic layer with respect to the widthwise direction.

5. An apparatus according to claim 3, wherein said pressing member has a length which is shorter than a length of said parting layer and longer than the maximum width of the recording material.

* * * * *